United States Patent [19]

Rothlin

[11] Patent Number: 4,978,818

[45] Date of Patent: Dec. 18, 1990

[54] KEY FOR A CIRCUIT BOARD

[75] Inventor: Peter Rothlin, Winterthur, Switzerland

[73] Assignee: Sulzer Brothers Limited, Winterthur, Switzerland

[21] Appl. No.: 505,846

[22] Filed: Apr. 6, 1990

[30] Foreign Application Priority Data

Apr. 10, 1989 [CH] Switzerland ..... 1344/89

[51] Int. Cl.[5] ..... H01H 5/18

[52] U.S. Cl. ..... 200/406; 200/516; 200/513

[58] Field of Search ..... 200/406, 407, 511, 512, 200/513, 516, 59, 517, 520

[56] References Cited

U.S. PATENT DOCUMENTS

| | | | |
|---|---|---|---|
| 2,415,448 | 2/1947 | Stilwell | 200/67 |
| 3,806,673 | 4/1974 | Boulanger | 200/516 |
| 3,941,964 | 3/1976 | Yoder | 200/516 |
| 3,996,428 | 12/1976 | Buan et al. | 200/516 |
| 4,029,916 | 6/1977 | Chu | 200/406 |
| 4,084,071 | 4/1978 | Smith | 200/516 |
| 4,163,125 | 7/1979 | Boulanger | 200/516 |
| 4,778,952 | 10/1988 | Watkins et al. | 200/406 |

FOREIGN PATENT DOCUMENTS

| | | | |
|---|---|---|---|
| 3145434 | 5/1983 | Fed. Rep. of Germany . | |
| 3226008 | 1/1984 | Fed. Rep. of Germany . | |
| 0221825 | 9/1989 | Japan | 200/511 |
| 1332401 | 8/1987 | U.S.S.R. | 200/516 |

*Primary Examiner*—Ernest G. Cusick
*Assistant Examiner*—Glenn T. Barrett

[57] ABSTRACT

A key for printed circuit boards comprises an electrically conductive snap disk embedded in a recess in a spacer layer between a cover foil and a board coated with printed conductors. The key is used as an opener key with a pressing point, to which end, the snap disc has contact tabs and, offset therefrom tension tabs. The tension tabs are fixed to the board with biasing in order to produce the necessary contact pressure in the unactuated state. Each contact tabs has a shoulder which is curved towards the board and which upon actuation of the snap disk bears on the board and, with increasing actuating force, reduces the contact force (Fc) of the contact tab until the contact surface disengages. Disengagement of the contact surfaces and the passage through the pressure point or peak value for the actuating force (Fa) occurs at the same deformation travel (d) of the snap disk.

14 Claims, 1 Drawing Sheet

KEY FOR A CIRCUIT BOARD

Figure 1:
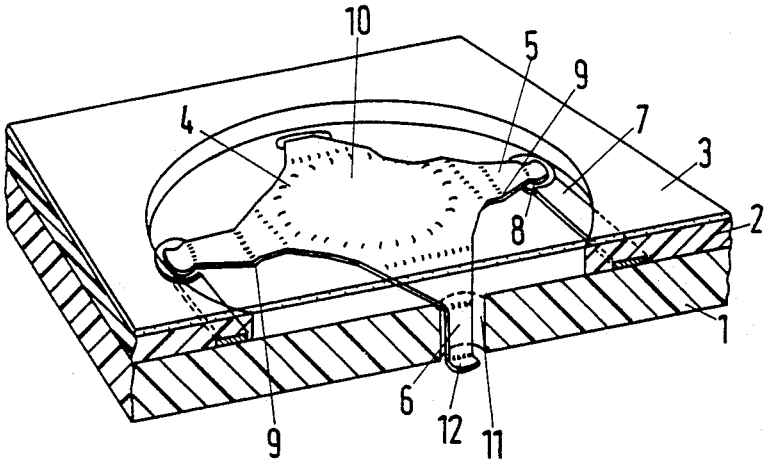

This invention relates to a key for a circuit board. More particularly, this invention relates to a key for a printed circuit board.

Heretofore, various types of keys employing snap disks have been utilized in a touch-sensitive keyboard or keypad. For example, German, O.S. No. 3145434 describes the use of a snap disk having a centrally disposed bulge and four radially directed tabs which is used as a closure to close an electric circuit when mechanically actuated. French patent specification No. 8001600 describes various forms of touch-sensitive keys in which printed conductors, which move to some extent, are disposed on deformable foils. This French publication discloses the principle of an opener in the form of a spring which is clamped at one end and which is raised through a foil coated with a printed conductor to disengage from such conductor.

U.S. Pat. No. 2,415,448 describes a snap switch which employs a toggle spring of circular construction which is maintained in a bowed shape under elastic tension so as to be moved from one position of stable equilibrium to another after an initial impulse movement is applied. German O.S. No. 3226008 illustrates another type of switch arrangement.

The function of opener keys is to interrupt circuits directly for safety reasons. Such keys must have a long working life and be reliable in operation and must not mis-operate because of impacts and vibrations. Such opener keys are nearly always disposed directly adjacent closure keys. Although closure keys have been used in touch-sensitive keyboards for a number of years, openers are not available in anything like equivalent constructions.

Accordingly, it is an object of the invention to provide an opener key for a touch-sensitive keyboard which is operationally equivalent to or better than a closure key.

It is another object of the invention to provide a key for a circuit board of relatively simple construction.

It is another object of the invention to provide a relatively simple opener key for a touch-sensitive keyboard.

Briefly, the invention provides a key for a printed circuit board which is in the form of an electrically conductive snap disk. This key or snap disk is provided with a centrally disposed dome-shaped bulge, a pair of contact tabs which extend radially from the bulge with each having a contact surface at one end for contacting an electrical conductor and a pair of tension tabs extending radially from the bulge for mounting on a circuit board.

In addition, each contact tab has a bent portion between the contact surface thereof and the bulge in order to define a shoulder for engaging a circuit board in response to depressing of the bulge toward the circuit board in order to effect a lifting of the contact surface from an electrical conductor.

When incorporated into a keyboard or keypad, the snap disk is mounted by way of the contact tabs on a circuit board having at least two electrical conductors thereon. In addition, a spacer layer is disposed on the circuit board with a recess receiving the snap disk. In this respect, when in an inoperative state, the contact tabs of the snap disk are supported only on the printed conductors. In response to a depressing of the bulge towards the circuit board, the shoulder of each contact tab engages with the circuit board and serves to lift each end of the contact tab from the respective electrical conductor. To this end, each contact tab has a resilient zone between the shoulder thereof and the bulge for sliding on the board in an outward direction while pivoting the contact surface away from the respective conductor in response to the depressing of the bulge toward the board. In this respect, the shoulder increases the mechanical force opposing the depression of the bulge.

In addition to the above, a cover is secured to the spacer layer to extend over the recess in contact with the bulge of the disk. In addition, the cover may be in biased contact with the bulge in order to exert a biasing force to maintain the contact surfaces of the contact tabs in contact with the printed conductors.

By virtue of different arrangements of printed conductors and by virtue of differently devised snap disks, openers and closures may be manufactured together on a printed board. Thus, the user may be given the same tactile sense of execution of the function by overshooting of a pressure point. In this respect, when an activating force is applied in the region of the bulge of the snap disk, at least one contact tab disengages from a printed conductor. Further, after overshooting a peak value, the actuating force decreases appreciably until the bulge rests on the board and, by virtue of the greater rigidity of the bulge, protects the contact tabs and tension tabs against excessive deformations.

The sizing and dimensioning of the snap disk is such that the contact force between the contact tabs and the electrical conductors drops to zero, at the latest, when the actuating force on the bulge reaches a peak value. This ensures that the contact tabs disengage from the printed conductors. The disengagement of the contact surfaces of the contact tabs from the conductors before the peak value is reached may be varied by varying the height of the conductors above the board near the contact surface of the contact tab.

Further, the resilience and distance of the cover are so adapted to the height and diameter of the snap disk that a human actuating finger automatically rolls towards the bulge.

The closure key may be readily used for the manual opening of circuits on printed circuit boards.

Figure 2:
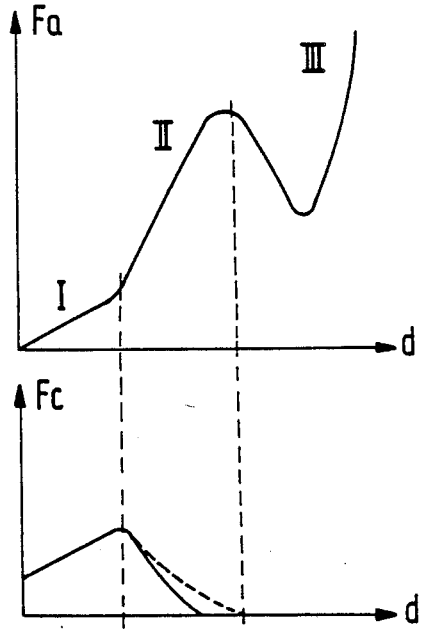

These and other objects and advantages of the invention will become more apparent from the following detailed description taken in conjunction with the accompanying drawings wherein:

FIG. 1 illustrates a perspective view of part of a printed circuit board having a touch-sensitive key in accordance with the invention used as an opener; and FIG. 2 graphically illustrates the actuating force and contact force of an opener key plotted against the deformation movement of the snap disk in accordance with the invention.

Referring to FIG. 1, the touch-sensitive key is mounted on a circuit board 1 having a pair of printed electrical conductors 7. As indicated, a spacer layer 2 is disposed on the board 1 and has a recess within which an electrically conductive snap disk 4 is located. In addition, a cover 3 of foil material is secured over the spacer layer 2 and extends over the recess in biased contact with the disk 4.

As illustrated, the snap disk 4 has a centrally disposed dome-shaped bulge 10, a pair of contact tabs 5 extending radially from the bulge 10 with each contact tab 5 having a contact surface 8 contacting with an electrical conductor 7. In addition, the disk 4 has a pair of tension tabs 6 which extend radially from the bulge 10 for mounting on the circuit board 1. To this end, the circuit board 1 has a pair of apertures 11 through which the tension tab 6 pass. Each tension tab 6 also has a flange 12 engaging on an underside surface of the board 1 in order to secure the disk 4 to the board 1. In this respect, the tension tab 6 are fixed to the board 1 so as to bias the snap disk 4 in such a manner that the contact tabs 5 form a resilient yoke.

In an inoperative state, the contact tabs 5 are biased into engagement with the printed conductor 7.

Each contact tab 5 also has an intermediately disposed bent portion between the contact surface 8 and the bulge 10 to form a shoulder 9 for engaging the circuit board 1. In addition, a resilient zone is formed between the shoulder 9 and the bulge 10. In response to depressing of the bulge 10 toward the circuit board 1, the resilient zone of each contact tab 5 causes the shoulder 9 to slide on the board 1 outwardly of the bulge 10 while pivoting the contact surface 8 at the end of the contact tab 5 away from the respective conductor 7. In this respect, when the snap disk 4 is depressed in the actuating direction d, the necessary actuating force Fa and the contact force Fc initially increase in a zone I until the shoulder 9 bears on the board 1. Because of the shortened lever effect between the shoulder 9 and the bulge 10, the necessary actuating force increases more steeply in a second zone II, the resilient zone between the shoulder 9 and bulge 10 deflecting inwardly resiliently while the shoulder 9, originally biased from the contact surface 8, pivots on the board 1 with a sliding movement and the contact force Fc decreases until the surface 8 disengages from the conductor 7. The resilient elements are so dimensioned and so adapted to the height of the conductor 7 near the contact surface 8 that the contact surfaces 8 disengage at the latest when the actuating force Fa reaches a peak value.

In a following third zone III, the actuating force Fa initially decreases with increasing deformation in the actuating direction d until the bulge 10 is resting on the board 1. By resting on the board 1 which opposes substantially increased resistance, the bulge 10 protects the other parts of the snap disk 4 from being overstressed. The contact force Fa depends, in the normal state, upon the biasing of the tension tabs 6, the same centering the snap disc 4 and, as illustrated, extending through the apertures 11 in the board 1 and catching by way of the projecting flanges 12 on the back of the board 1. Other possibilities for fixing and abutments are the use of potting, sticking or pressing on of the tension tabs 6.

The clearance between the snap disc 4 and the cover foil 3 is used in the case of negative clearance—i.e. overlapping—to increase the contact force Fc in the normal state and in the case of positive clearance to center an actuating finger.

The invention thus provides an opener key of relatively simple construction which can be readily actuated. In this respect, the opener key may be actuated in a simple manner with the same touch as a closer key. One preferred use of the opener key is in appliances for filling tanks of motor vehicles with gas.

Further, the invention provides an opener key in which the disengagement of the contact surfaces of the contact tabs and the passage of the bulge through a pressure point or peak value for the actuating force Fa occurs at the same deformation travel of the bulge.

The embodiments of the invention in which an inclusive property or privilege is claimed are defined as follows:

1. A key for a circuit board comprising a centrally disposed dome-shaped bulge;

a first pair of tabs extending radially from said bulge for mounting on a circuit board; and a pair of contact tabs extending radially from said bulge, each contact tab having a contact surface at one end for contacting an electrical conductor and a bent portion between said contact surface and said bulge defining a shoulder for engaging a circuit board in response to depressing of said bulge toward the circuit board to effect a lifting of said contact surface from an electrical conductor.

2. A key as set forth in claim 1 wherein each said shoulder is directed in a direction opposite to the direction of said bulge.

3. A key as set forth in claim 1 wherein each tab of said first pair of tabs has an outwardly directed flange for engaging an undesirable surface of a circuit board.

4. In combination, a circuit board having at least two electrical conductors thereon;

a spacer layer disposed on said board and having a recess therein; and an electrically conductive snap disc disposed within said recess, said disc including a centrally disposed bulge, a pair of contact tabs extending outwardly of said bulge and disposed in contact with said conductors, a pair of tension tabs extending outwardly of said bulge and secured to said circuit board to bias said contact tabs into contact with said conductors, each said contact tab having an intermediately disposed bent portion between a respective conductor and said bulge for engagement with said circuit board in response to depressing of said bulge towards said circuit board to effect a lifting of said respective contact tab from a respective electrical conductor.

5. The combination as set forth in claim 4 wherein each contact tab has a contact surface at one end for contacting a respective conductor in an inoperative state of said disc and a resilient zone between said shoulder thereof and said bulge for sliding said shoulder on said board outwardly of said bulge while pivoting said contact surface away from said respective conductor in response to depressing of said bulge towards said board.

6. The combination as set forth in claim 5 wherein each said resilient zone is of sufficient resiliency to permit said bulge to be depressed against said board.

7. The combination as set forth in claim 4 wherein said board has a pair of apertures having said tension tabs passing therethrough, each said tension tab having a flange engaging an underside surface of said board.

8. The combination as set forth in claim 4 wherein each said resilient zone is of sufficient resiliency to permit said bulge to be depressed against said board.

9. The combination as set forth in claim 4 which further comprises a cover secured to said space layer and extending over said recess in biased contact with said bulge of said disc.

10. The combination as set forth in claim 9 wherein at least one contact tab disengages from a respective conductor in response to an activating force being applied to said cover in a region of said bulge.

11. In combination, a circuit board having at least two electrical conductors thereon;

a spacer layer disposed on said board and having a recess therein; and an electrically conductive snap disc disposed within said recess, said disc including a centrally disposed bulge and a pair of contact tabs extending outwardly of said bulge and disposed in contact with said conductors, each said contact tab having an intermediately disposed bent portion between a respective conductor and said bulge for engagement with said circuit board in response to depressing of said bulge towards said circuit board to effect a lifting of said respective contact tab from a respective electrical conductor.

12. The combination as set forth in claim 11 which further comprises a cover secured to said space layer and extending over said recess in biased contact with said bulge of said disc.

13. The combination as set forth in claim 12 wherein each contact tab has a contact surface at one end for contacting a respective conductor in an inoperative state of said disc and a resilient zone between said shoulder thereof and said bulge for sliding said shoulder on said board outwardly of said bulge while pivoting said contact surface away from said respective conductor in response to depressing of said bulge towards said board.

14. The combination as set forth in claim 11 wherein said board has a pair of apertures and said disc has a pair of tension tabs passing through said apertures each tension tab having a flange engaging an underside surface of said board to mount said disk thereon in a biased manner.

* * * * *

UNITED STATES PATENT AND TRADEMARK OFFICE

CERTIFICATE OF CORRECTION

PATENT NO. : 4,978,818

DATED : December 18, 1990

INVENTOR(S) : PETER ROTHLIN

It is certified that error appears in the above-identified patent and that said Letters Patent is hereby corrected as shown below:

On the title page:
In the Abstract, line 9 "contact tabs has" should be -contact tab has"
Column 3, line 6 "tab 6" (first occurrence) should be -tabs 6-
Column 3, line 9 "tab 6" should be -tabs 6-

Signed and Sealed this

Twenty-eighth Day of July, 1992

*Attest:*

DOUGLAS B. COMER

*Attesting Officer*

*Acting Commissioner of Patents and Trademarks*